US005611440A

United States Patent [19]

Møller

[11] Patent Number: 5,611,440

[45] Date of Patent: Mar. 18, 1997

[54] SALES RACK FOR KITCHEN UTENSILS

[75] Inventor: Jens P. Møller, Ryslinge, Denmark

[73] Assignee: Ryslinge Traevarer APS, Ryslinge, Denmark

[21] Appl. No.: 441,834

[22] Filed: May 16, 1995

[30] Foreign Application Priority Data

May 17, 1994 [DE] Germany ..... 94 08 087 U

[51] Int. Cl.[6] ..... A47F 7/00

[52] U.S. Cl. ..... 211/70.7; 211/181; 108/181

[58] Field of Search ..... 211/106, 103, 211/70.7, 193, 187, 181, 90; 108/108, 181

[56] References Cited

U.S. PATENT DOCUMENTS

| | | | |
|---|---|---|---|
| 1,951,617 | 3/1934 | Kress | 211/90 |
| 2,818,980 | 1/1958 | Losching | 211/181 X |
| 3,268,087 | 8/1966 | Kramer | 211/70.6 X |
| 3,294,351 | 12/1966 | Rollins | 211/90 X |
| 3,316,863 | 5/1967 | Zock | 108/108 |
| 3,730,108 | 5/1973 | Stroh | 108/108 |
| 3,993,002 | 11/1976 | Stroh | 211/90 X |
| 4,318,478 | 3/1982 | De Winter | 211/70.7 X |
| 4,345,688 | 8/1982 | De Boer | 211/106 X |
| 5,272,991 | 12/1993 | Carrigan | 211/193 X |
| 5,472,103 | 12/1995 | Merl | 211/90 X |

*Primary Examiner*—Robert W. Gibson, Jr.
*Attorney, Agent, or Firm*—Friedrich Kueffner

[57] ABSTRACT

The sales rack serves to accommodate kitchen utensils (230) possessing stem-like handles and is for this purpose provided with a vertical rear wall (10) with legs (13,13';14,14') and with a plurality of superposedly arranged and spaced-apart accommodation means (20,20',20") for the kitchen utensils (230), while each accommodation means (20;20';20") is formed of two fully coincidentally constructed lattice plates (30,130) which are superjacent and interconnected at a distance from each other and possess a number of lattice perforations (31,131) consecutively and juxtaposedly arranged as insertion apertures for the kitchen utensils (230), wherein the two lattice plates (30,130) of each accommodation means (20;20';20') are, at the front, connected by means of a facing strip (35), which carry a plurality of type identification signs (40) retained on the facing strip, whose number corresponds to the number of the rows (R1 through R8) formed by the consecutively arranged lattice perforations (31,131).

17 Claims, 3 Drawing Sheets

SALES RACK FOR KITCHEN UTENSILS

The present invention relates to a sales rack for kitchen utensils possessing handles, such as mixing spoons, dough pallet knives, mixing whisks and suchlike of wood or of other suitable materials.

BACKGROUND OF THE INVENTION

Kitchen utensils, more particularly of wood, such as mixing spoons, pallet knives for dough, mixing whisks or beaters, pastry brushes and the like are offered for sale in various receptacles, such as tubs, ceramic pots and suchlike and this, in the majority of cases, unsorted as to their intended use so that the well-ordered arrangement so often desired by the purchaser does not exist, particularly when different sizes of one and the same type, e.g. a mixing spoon, are available. To this is added the circumstances that, owing to a lacking well-ordered arrangement, the placing of repeat orders of the individual kitchen utensils becomes very difficult, that is to say that it is not discernible at a glance with articles are missing so as to make a reordering possible.

That is why the technical problem of the present invention is to provide a sales rack according to the type described the beginning, which renders a well-arranged disposition of kitchen utensile, such as mixing spoons, pallet knives, mixing whisks or beaters and suchlike, in particular also in the most widely varied sizes and the control of these kitchen utensils at one glance possible so as to facilitate the selection for the purchaser and in order to be able to spot missing articles clearly for reordering. With this sales rack it is intended to improve logistics, in which connection the intention is also to simplify the reordering of the goods in that the individual articles can be controlled and reordered with the aid of type idendification means in connection with order numbers.

SUMMARY OF THE INVENTION

This technical problem is solved by means of the features characterized in Claim 1.

According to the invention, the sales rack including a vertical rear wall with legs attached to the same and of a plurality of accommodation or receiving means secured to the rear wall and superposedly arranged at intervals for the kitchen utensils, in which case each accommodation means is formed of two interconnected square or rectangular lattice plates designed so as to be in full coincidence and superjacent in a spaced-apart manner, which possess a plurality of lattice perforations disposed inseries and in a juxtaposed arrangement in the form of insertion apertures for the kitchen utensils. The two lattice plates of each accommodation means, at the front, are interconnected by means of a facing strip and bear a number of type identification signs retained on the facing strip, which number corresponds to the number of rows formed by the lattice perforations in consecutive arrangement.

The individual kitchen utensile are arranged in a thusly designed sales rack in a well-orders and well-arranged fashion, in which case the individual rows comprised of lattice perforations consecutively arranged in each case accommodate a large number of kitchen utensile of the same type, while the number of the lattice perforations of each row corresponds to a number of kitchen utensils of the same type corresponding to the accommodation means of the sales rack. If articles are now removed from the sales rack, then the erector of the sales rack will be able to clearly see at a glance how many articles of which type of kitchen utensil have to be reordered. Also for the purchaser, this well-ordered arrangement of the most widely varying kitchen utensils is of additional assistance when selecting kitchen utensils to be purchased in each case since the same are accommodated, with regard to different sizes and in the most widely varying designs, in rows in the individual accommodation means. As the kitchen utensils are provided with stem-like handles in which the working parts of the kitchen utensils possess larger dimensions in comparison with the stem-like handles, it is possible to arrange the kitchen utensils in the lattice perforations of the individual accommodation means of the sales rack in such a way that the working parts of the kitchen utensils come to be located above the accommodation means, while the stem-like handles are inserted through the lattice perforations of the two lattice plates forming one accommodation means at a time. Especially advantageous in this sales rack is the disposition of type identification signs on the front facing strip which interconnects the two lattice plates of each accommodation means of the sales rack. One type identification sign each is allocated to each lattice perforation, upon which the type of the kitchen utensil, e.g. in connection with an order number, is noted, while it is also possible for these type identification signs to bear the prices of the individual kitchen utensils. In this case the type identification signs are retained in such a way on the facing strip of the individual accommodation means that an effortless replacement with other identification signs is possible. Furthermore, the type identification signs stating the type of the individual kitchen utensil make an unproblematic reordering of missing articles possible. Moreover, these type identification signs may additionally provided with advertising legends.

DETAILED DESCRIPTION OF THE PREFERRED EMBODIMENT

Figure 1:
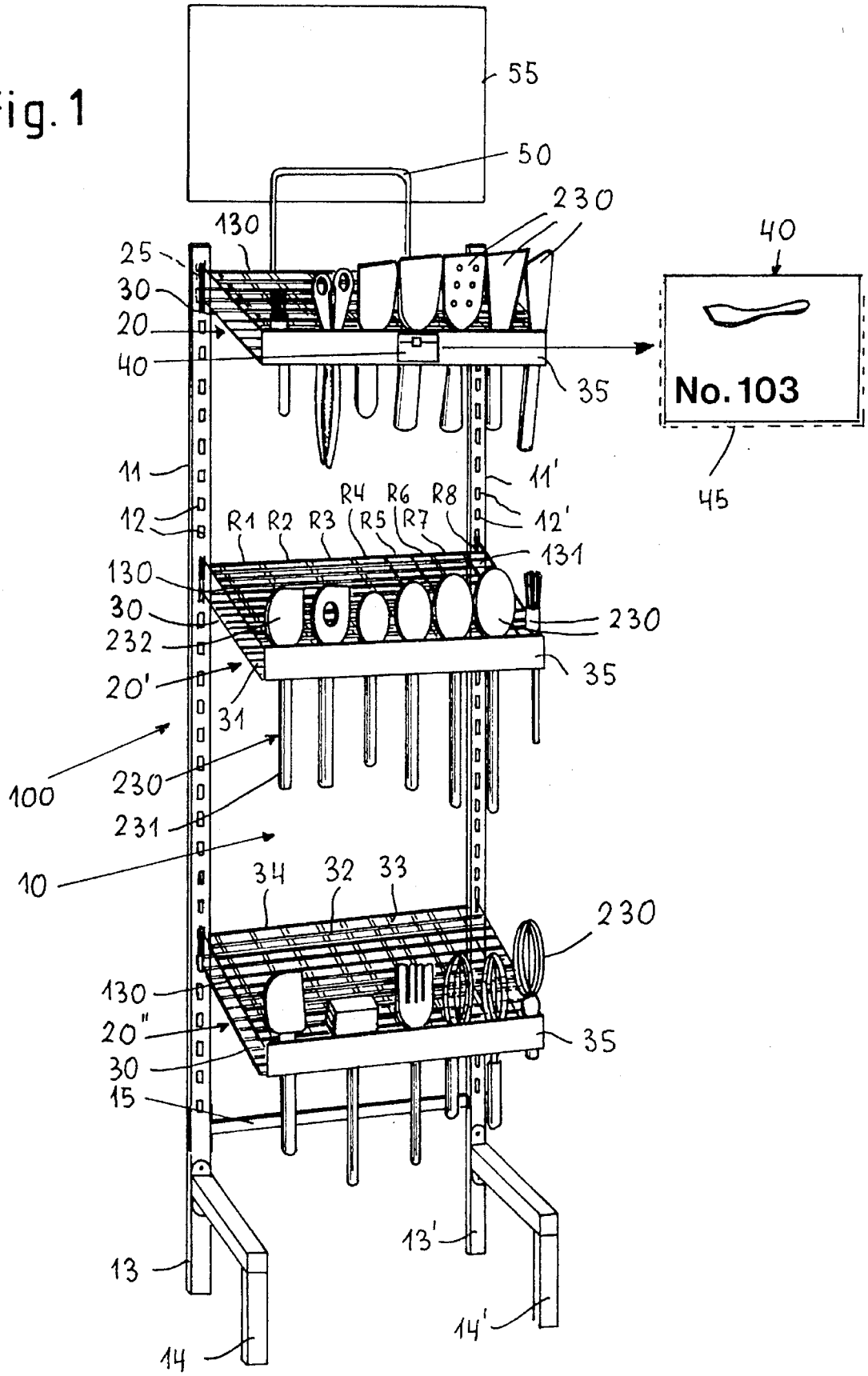
FIG. 1 is a diagrammatical view of the sales rack with two shelf bottom-like accommodation means for the most widely varied kitchen utensils.

The sales rack 100 for kitchen utensils 230, such as mixing spoons, pallet knives for dough, whisks or beaters, pastry brushes, mixing whisks and suchlike, of wood or of other suitable materials, is comprised of a vertical rear wall 10 which is formed of two supporting columns 11,11' which, by means of connecting rods 15, are maintained at a distance predetermined by the length of these connecting rods. The supporting columns 11,11' of the rear wall 10 form at the same time the rear legs 13,13' while, by means of L-shaped sectional rods which are secured to the supporting columns 11,11', the front legs 14,14' are formed which project in relation to the rear wall 10. The legs 13,13' and 14,14' may also be constructed with lockable runners for rendering the sales rack 100 mobile.

In addition, the sales rack 100 comprises a plurality of horizontal accommodation means 20,20',20" for the kitchen utensils 230 which are fastened to the rear wall 10, i.e. on the support columns 11,11' of the latter and so as to be superjacently disposed at a distance from each other. Each accommodation means 20,20',20" is formed of square or rectangular lattice plates 30,130 that are constructed so as to be in full coincidence and supercantly disposed at a distance from each other and interconnected, which are provided with a plurality of lattice perforations 13,131 located arranged in series and juxtaposedly arranged, which constitute the insertion apertures for the kitchen utensils 230. This construction produces the advantage that it is possible to dispose the kitchen utensils in a vertical position.

In the rearward area, each accommodation means 20,20', 20" possesses insertion mounting means 25, while each supporting column 11,11' of the rear wall 10 is provided with a number of perforations 12,12' proceeding in the longitudinal direction of the supporting columns, in which the insertion mounting means 25 are retained on the rear of each accommodation means 20,20',20", in which case these insertion mounting means 25 are designed in such a way that, following the insertion of these mounting means into the perforations 12,12' in the supporting columns 11,11', a locking of the accommodation means 20,20',20" takes place.

The number of the accommodation means 20,20',20" secured to the rear wall 10 or to the supporting columns 11,11' of the same can be arbitrarily selected and does in each case depend on the height of the sales rack 100. In the embodiment example of a sales rack 100 illustrated in the drawing, three accommodation means 20,20',20" are provided. All three accommodation means 20,20',20" are of identical design, except that lattice perforations 13,131 are required in the lattice plates 30,130 that possess different dimensions so as to make it possible to accommodate, by way of example, kitchen utensils, whose stem-like handles 231 possess a greater width. What is essential is that the kitchen utensils to be accommodated in the sales rack are provided with a stem-like handle 231 which, in comparison with the working parts 232 of the individual kitchen utensils 230, possess a smaller width or a smaller diameter, as can be gathered from the drawing. These working parts 232 are those portions of the kitchen utensils with the aid of which the respective ingredients necessary for the preparation of a meal are prepared.

The two lattice plates 30,130 of each accommodation means 20,20',20" are, ar the front, connected by means of a facing strip 35, which carries a number of of type identification sings retained on the facing strip 35 corresponding to the n umber of the rows R1,R2,R3,R4,R5,R6,R7, R8 formed of the lattice perforations disposed in series arrangement 31,131. The number of the individual rows of consecutively disposed lattice perforations 13,131 of each accommodation means 20,20',20" does in each case depend on the type and size of the kitchen utensils 230 to be accommodated. By way of example, the accommodation means 20 of the sales rack 100 depicted in the drawing possesses eight rows of consecutively disposed lattice perforations 31,131, in which case these rows are designated with R1 through R8.

The lattice perforations 31,131 of the two lattice plates 30,130 of each accommodation means 20,20',20" of each row of consecutively disposed lattice perforations 31, 131 possess different dimensions in comparison with the lattice perforations 31,131 in the lattice plates 30, 130 of other rows in order to be able to accommodate kitchen utensils 230 having different dimensions in the sales rack 100. However, there also exists the possibility of providing the lattice perforations 31,131 in the lattice plates 30,130 of each accommodation means 20,20', 20" in relation to other rows with identical dimensions so that, by way of example, the lattice perforations in the lattice plates 30,130 of an accommodation means possess identical dimensions.

The lattice perforations 31,131 of the two lattice plates 30,130 of each accommodation space 20,20',20" are in full coincidence with each other. Each lattice plate 30, 130 is preferably comprised of crosswise arranged metal bars 32,33; which, at the end, are connected by means of a circumferential frame 34 formed of a metal rod. In lieu of lattice plates 30,130 comprised of crosswise arranged metal bars 32,33, it is also possible for lattice plates to be employed which are provided with hole-like perforations formed in series, in which case these hole-like perforations may e.g. be circular, but have to be dimensioned in such a way that it is possible to pass the stem-like handles 231 of the kitchen utensils 230 through the same.

The type identification sign 40 allocated to each row R1 through R8 of consecutively arranged lattice perforations 31,131 of the two lattice plates 30,130 of each accommodation means 20,20',20" is, with the aid of a pocket-like mounting 45 of a see-through plastic sheet or film, or with the aid of two laterally disposed guide rails or with the sid of a magnetic mounting, retained on the facing strip 35.

The topmost accommodation means 20 of the sales rack 100 may be additionally provided with a mounting means 50 for an insertable information/advertising sign 55.

Instead of the two lattice plates 30,130, it is also possible to employ an orifice plate possessing a thickness ensuring a vertical mounting of inserted kitchen utensils 230.

Figure 2:
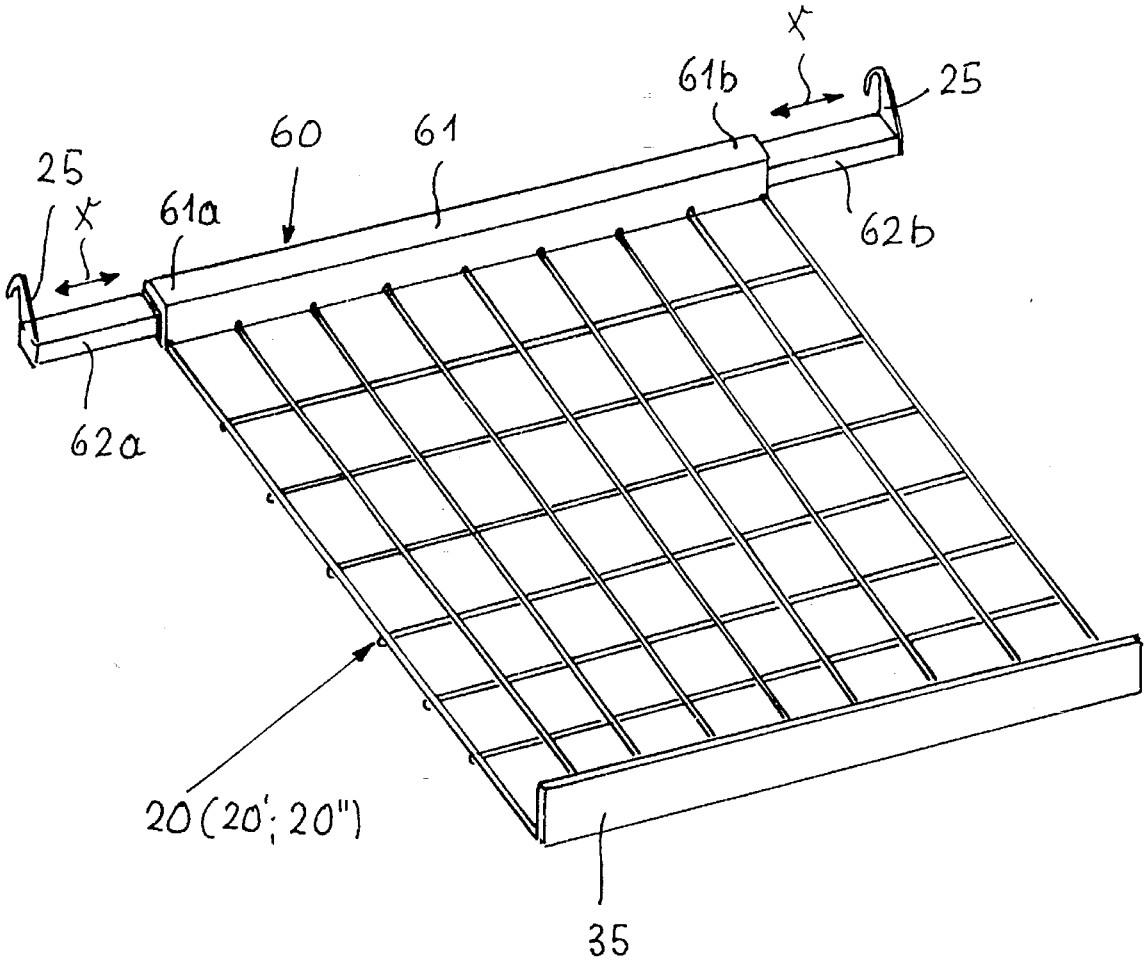
FIG. 2 shows, in a diagrammatical view of an accomodation means with insertion mounting means whose spacing is variable for the supporting columns of the sales rack.
Figure 3:
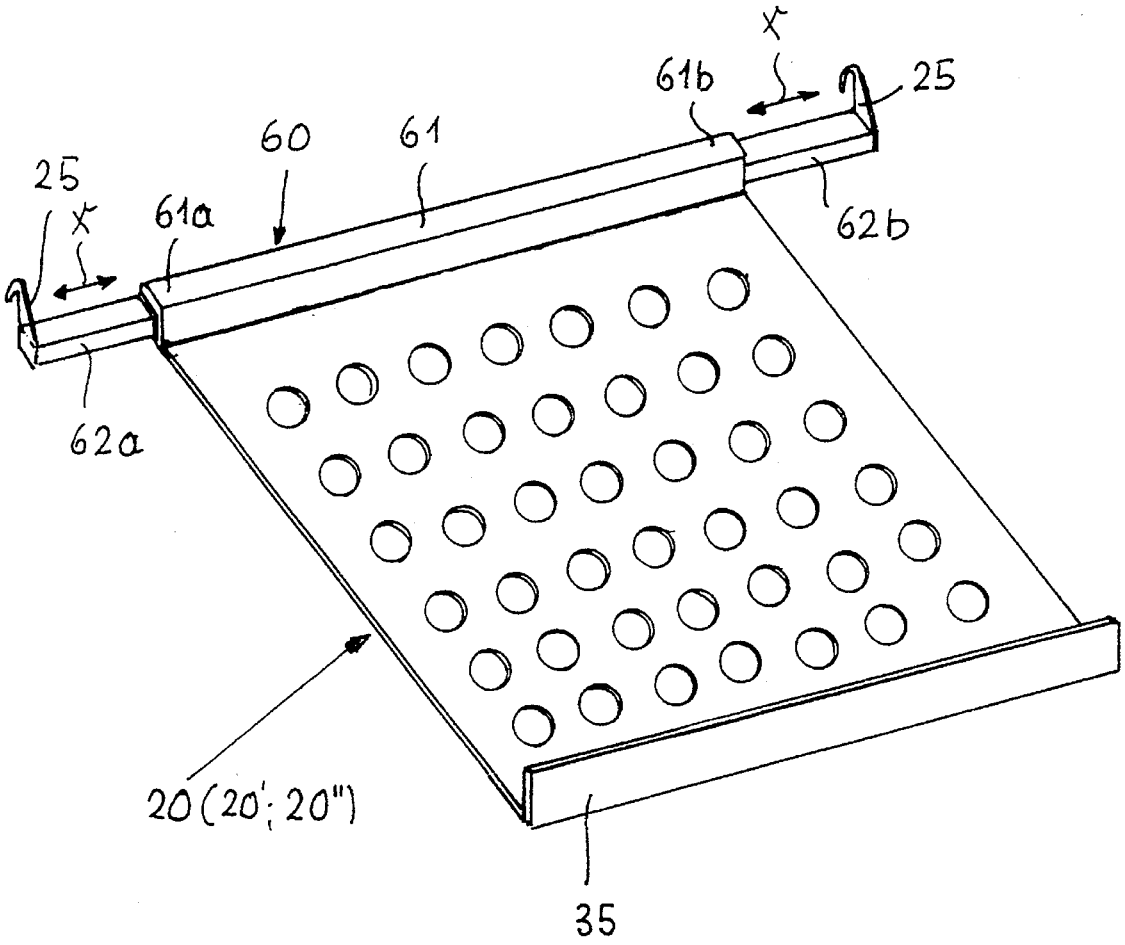
FIG. 3 is a diagrammatical view, similar to FIG. 2, showing an accommodation means in the form of a plate with orifices.

Each lattice-like configured accommodation means 20,20', 20" is provided with two insertion mounting means 25 each on the rear sides for the attachment to the supporting columns 11,11'. In order to be able to use these accommodation means 20,20',20" with predetermined dimensions also in such sales racks in which the distance between the two supporting columns 11,11' varies, the insertion mounting means 25 are attached in such a way that their distance can be adapted to the respective distance of two supporting columns 11,11'. For this, each accommodation means 20,20', 20" possesses, within its rearward region, a rod like mounting means 60 which is expediently comprised of a square pipe 61. Provided on the two ends **61*a*,61*b* of the square pipe 61 are telescopic, i.e. withdrawable and extensible in the direction of the arrow X, pipe sections 62*a*,62*b* which, in turn, carry on their free ends the insertion mounting means 25 (FIG. 2). By means of this displaceability of the pipe sections 62*a*,62*b*, the distance between two insertion mounting means 25 is variable and adaptable to the respecive distance from each other of two supporting columns 11,11'**.

The displaceable pipe sections **62*a*,62*b*** are lockable in their respective retraction and extension positions with the aid of arresting devices, such as e.g. angaging or clamping means.

The sales rack may be fabricated both from metallic materials as well as from wood.

The possibility also exists of fabricating the bearing elements of the sales rack from a metallic material, whereas the accommodation means 20,20',20" for the kitchen utensils are fabricated from wood. It is also possible to employ plastics as material for the sales rack.

What is claimed is:

1. A sales rack for kitchen utensils having stem-like handles, the sales rack comprising a vertical rear wall, a plurality of superposed horizontal accommodation means each having a front and a rear, the horizontal accommodation means being arranged at a distance from each other for accommodating the kitchen utensils and being attached to the rear wall, each horizontal accommodation means comprising two interconnected square or rectangular support plates of identical construction, each support plate having a plurality of perforations arranged consecutively and disposed juxtaposedly in the form of insertion apertures for the kitchen utensils, a facing strip attached to the front of each horizontal accommodation means for connecting the two support plates of each horizontal accommodation means, each facing strip carrying a number of type identification signs, wherein the number of type identification signs corresponds to a number of rows formed by the consecutively arranged perforations.

2. The sales rack according to claim 1, wherein the rear wall comprises two vertical supporting columns and connecting rods mounted at a distance from each other for connecting the vertical supporting columns, each vertical supporting column having a plurality of perforations extending in a longitudinal direction of the supporting column, each horizontal accommodation means having at the rear thereof insertion mounting means for insertion into the perforations of the supporting columns.

3. The sales rack according to claim 2, further comprising legs attached to the vertical supporting columns.

4. The sales rack according to claim 1, wherein the perforations of the two superposedly arranged support plates of each horizontal accommodation means have dimensions which are smaller than a width of a working part of each kitchen utensil, wherein the width of the working part is greater than a width of the stem-like handle of each kitchen utensil.

5. The sales rack according to claim 1, wherein each type identification sign is mounted in a pocket-like mounting means comprising a transparent plastic sheet or film attached to the facing strip.

6. The sales rack according to claim 1, wherein each type identification sign is mounted on the facing strip with two laterally disposed guide rails.

7. The sales rack according to claim 1, wherein each type identification sign is mounted on the facing strip with a magnetic mounting means.

8. The sales rack according to claim 1, wherein the perforations have widths, and wherein the width of the perforations of one row of the perforations of the support plates is different from the width of the perforations of the other rows.

9. The sales rack according to claim 1, wherein the perforations of the two support plates of each horizontal accommodation means are located in full coincidence with each other.

10. The sales rack according to claim 1, comprising three superposedly arranged accommodation means.

11. The sales rack according to claim 1, wherein a topmost of the horizontal accommodation means comprises a mounting means for an information or advertising sign.

12. The sales rack according to claim 1, wherein each support plate comprises a circumferential frame formed of a metal bar, and a plurality of cross-wise arranged metal bars having ends, the ends of the cross-wise arranged metal bars being attached to the circumferential frame.

13. The sales rack according to claim 1, wherein each support plate is a lattice plate having lattice perforations.

14. The sales rack according to claim 1, wherein each support plate is a plate having orifices.

15. The sales rack according to claim 2, wherein the insertion mounting means at the rear of each accommodation means are constructed with a variable distance between the insertion mounting means.

16. The sales rack according to claim 15, wherein each accommodation means has on the rear thereof a rod-like mounting means in the form of a square pipe, the square pipe having ends, further comprising pipe sections telescopically mounted in the ends of the square pipe, the insertion mounting means being disposed on free ends of the pipe sections.

17. The sales rack according to claim 16, wherein the pipe sections are moveable between retraction and extension positions, further comprising arresting means for locking the pipe sections in the retraction position and the extension position.

* * * * *